US007900797B1

(12) United States Patent
Witcraft

(10) Patent No.: US 7,900,797 B1
(45) Date of Patent: Mar. 8, 2011

(54) LID SEPARATOR AND DISPENSING DEVICE

(76) Inventor: Daryl Dean Witcraft, Clark Fork, ID (US)

( * ) Notice: Subject to any disclaimer, the term of this patent is extended or adjusted under 35 U.S.C. 154(b) by 1386 days.

(21) Appl. No.: 11/005,739

(22) Filed: Dec. 6, 2004

Related U.S. Application Data

(60) Provisional application No. 60/536,131, filed on Jan. 12, 2004.

(51) Int. Cl.
*B65H 3/00* (2006.01)

(52) U.S. Cl. ..... 221/251; 221/208; 221/209; 221/186; 221/187; 221/248

(58) Field of Classification Search ..... 221/208, 221/251, 1–312 C, 221, 285, 185, 188, 190, 221/187, 186, 209, 247, 248
See application file for complete search history.

(56) References Cited

U.S. PATENT DOCUMENTS

| | | | | | |
|---|---|---|---|---|---|
| 2,704,629 | A * | 3/1955 | Andre et al. | 53/306 |
| 3,161,320 | A * | 12/1964 | Swanson | 221/255 |
| 3,263,860 | A * | 8/1966 | Haas | 221/274 |
| 3,767,082 | A * | 10/1973 | House | 221/279 |
| 3,872,997 | A * | 3/1975 | Armstrong et al. | 221/20 |
| 4,084,724 | A * | 4/1978 | Christophersen et al. | 221/20 |
| 4,319,441 | A * | 3/1982 | Credle | 53/131.3 |
| 4,959,944 | A * | 10/1990 | Heisler | 53/313 |
| 5,000,345 | A * | 3/1991 | Brogna et al. | 221/5 |
| 5,038,969 | A * | 8/1991 | Berger | 221/40 |
| 5,131,562 | A * | 7/1992 | Brown | 221/41 |
| 5,328,052 | A * | 7/1994 | Kizilos | 221/42 |
| 5,383,571 | A * | 1/1995 | Gunderson | 221/223 |
| 5,692,359 | A * | 12/1997 | Casler et al. | 53/306 |
| 6,098,839 | A * | 8/2000 | Hunnell | 221/197 |
| 6,474,503 | B2 * | 11/2002 | Davis | 221/223 |
| 6,786,359 | B1 * | 9/2004 | Schroeder | 221/222 |
| 6,832,698 | B1 * | 12/2004 | Dybul | 221/221 |
| 7,270,248 | B2 * | 9/2007 | Schroeder | 221/221 |
| 7,337,919 | B2 * | 3/2008 | Walsh et al. | 221/221 |
| 2005/0092767 | A1 * | 5/2005 | Schroeder | 221/208 |

* cited by examiner

*Primary Examiner* — Gene Crawford
*Assistant Examiner* — Michael K Collins
(74) *Attorney, Agent, or Firm* — Heisler & Associates

(57) ABSTRACT

A beverage container lid separator and dispenser is provided which allows individual beverage container lids to be dispensed in a neat and sanitary manner. The invention generally includes a vessel and an actuator, wherein a stack of lids is maintained in the vessel optionally within a housing. The vessel has an aperture at its lower end for dispensing the lids therefrom. The actuator is positioned below the vessel and extending up through a horizontal floor below the vessel, the floor supporting the lids thereon. In operation, the vessel preferably pivots to allow a bottom-most lid within the vessel to be pulled from underneath the vessel by the actuator. The vessel catches and maintains the remaining stack of lids for later dispensing by a subsequent user.

7 Claims, 6 Drawing Sheets

LID SEPARATOR AND DISPENSING DEVICE

CROSS-REFERENCE TO RELATED APPLICATIONS

This application claims benefit under Title 35, United States Code §119(e) of U.S. Provisional Application No. 60/536,131 filed on Jan. 12, 2004.

FIELD OF THE INVENTION

The present invention relates generally to beverage container lid dispensers, and more specifically to a device for separating and dispensing individual beverage container lids from a stack of nested beverage container lids and a method for use of such a device in dispensing beverage container lids.

BACKGROUND OF THE INVENTION

Various self-service devices for dispensing straws, cups, glasses, mugs and other beverage containers are known and readily available, wherein such straws and containers are dispensed in a sanitary manner. Unfortunately, however, similar suitable devices are not available for the sanitary dispensing of beverage container lids. Although there have been prior attempts to resolve the need for a sanitary beverage lid dispenser, an inexpensive, reliable, practical, sanitary, and self-service device and method for dispensing beverage lids had not yet been realized.

Beverage cup lids are typically dispensed to customers in a vertical stack or in elongated horizontal trays. When cup lids are tendered in a vertical stack, customers must grab a lid from the top of the stack. Customers of varying heights are not all able to conveniently reach the top of the stack. Because the lids are nested and held together via frictional fit, they will often stick together so that a customer will pick up more than one lid. The excess lids are normally put back on the stack, dropped on the counter, or thrown into the trash. When cup lids are presented in a tray or bin, two hands are often needed by a customer to separate the nested lids. Additionally, such lids frequently become disordered and are often handled by more than one customer, thus resulting in increased risk of unsanitary conditions.

In an attempt to solve these problems, some vendors store cup lids behind a counter, thereby requiring an employee to hand out lids as needed. In addition to being inefficient, this solution merely hides the problem from the public view rather than solving it. Still other vendors provide mechanical dispensers for tendering cup lids; however, such dispensers suffer from structural design flaws that render the dispensers deficient and commercially unsatisfactory. For example, many lid dispensers may only be utilized for specific lid sizes, shapes and/or styles. Further, some lid dispensers require a large number of parts, thereby making them expensive and difficult to manufacture and/or maintain. Less complicated lid dispensers are available, however, such dispensers fail to adequately deal with the problems of sanitation and waste.

Therefore, it is readily apparent that there is a need for a beverage container lid separator and dispenser, wherein cup lids are dispensed in an orderly and sanitary manner. Moreover, there is a need for such a device that may be utilized with lids of varying sizes, shapes, and/or styles and is inexpensive to manufacture and/or maintain.

SUMMARY OF THE INVENTION

Briefly described, in a preferred embodiment, the present invention overcomes the above-mentioned disadvantages and meets the recognized need for such a device by providing the lid separator and dispensing device of this invention.

According to its major aspects and broadly stated, the present invention in its preferred form is a lid separator/dispenser having, in general, a housing and an actuator. The housing is a receptacle for storing beverage lid containers, and the actuator facilitates the separating and dispensing of lids from the housing. A stack of lids is maintained within the housing, with the lids preferably pivotally secured therewithin. The actuator preferably includes some form of a pull assembly positioned below the vessel. The pull assembly or other actuator preferably includes some form of a hook or related structure to engage and pull lids individually from a bottom of the stack of lids, while some form of abutment is provided to keep the other lids in the stack of lids from being pulled.

To operate the dispenser, the actuator, such as the pull assembly, is pulled or otherwise operated by a user, wherein the hook or similar structure catches the bottom-most lid from the stack of lids and pulls the stack of lids until they contact the abutment. Upon contact with the stack of lids, the abutment optionally and preferably moves upwards, thereby allowing the bottom-most lid to be removed from the stack, and subsequently dispensed. Upon removal of the bottom-most lid, the stack is returned to its original position. The actuator, such as the pull assembly, is also returned to its original position wherein the device is reset to dispense another lid to a subsequent user.

Accordingly, a feature and advantage of the present invention is its ability to separate beverage container lids from a stack of such lids and selectively dispense individual lids one-at-a-time.

Another feature and advantage of the present invention is its ability to dispense beverage container lids in a neat and sanitary manner.

Still another feature and advantage of the present invention is its ability to dispense beverage container lids of virtually all sizes, shapes and/or styles.

Yet another feature and advantage of the present invention is its minimal number of parts, thereby creating a device that is easy and inexpensive to manufacture and/or maintain.

Still yet another feature and advantage of the present invention is its ease of use.

A further feature and advantage of the present invention is its ability to dispense beverage container lids from a stack of such lids, wherein direct user contact with the stack of lids is eliminated, thereby preventing the unsanitary conditions which occur when multiple users handle a stack of such lids.

Still another feature and advantage of the present invention is that reduction in waste is afforded by its use.

These and other features and advantages of the present invention will become more apparent to one skilled in the art from the following description and claims when read in light of the accompanying drawings.

DESCRIPTION OF THE PREFERRED EMBODIMENT

Figure 1:
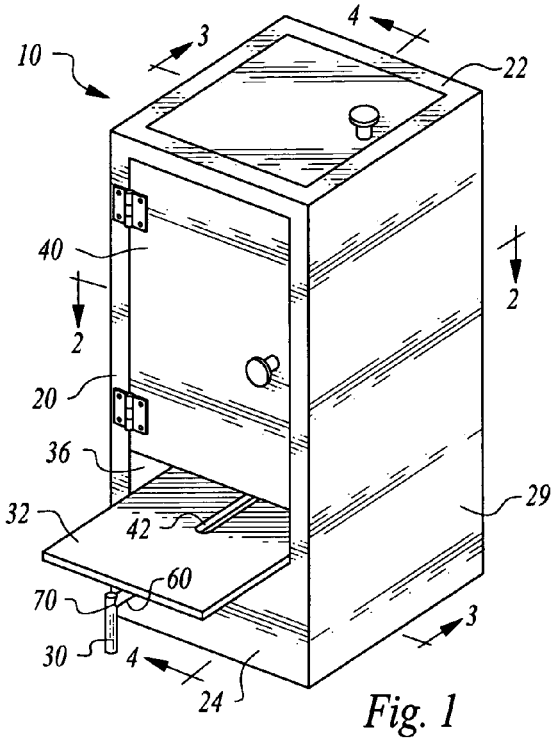
FIG. 1 is a top perspective view of a lid separator and dispensing device according to one embodiment of the present invention.
Figure 2:
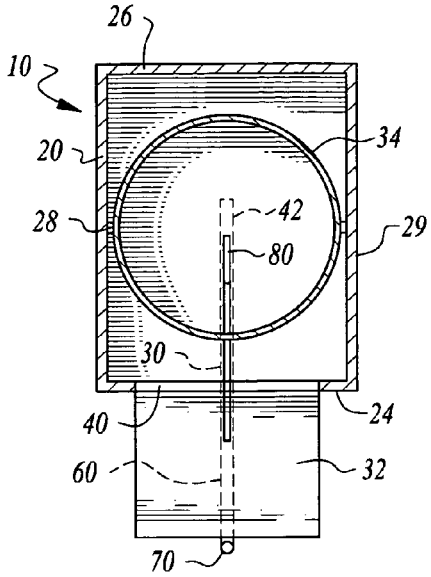
FIG. 2 is a top cross-sectional view along lines 2-2 of FIG. 1 of the lid separator and dispensing device according to a preferred embodiment of the present invention.
Figure 3:
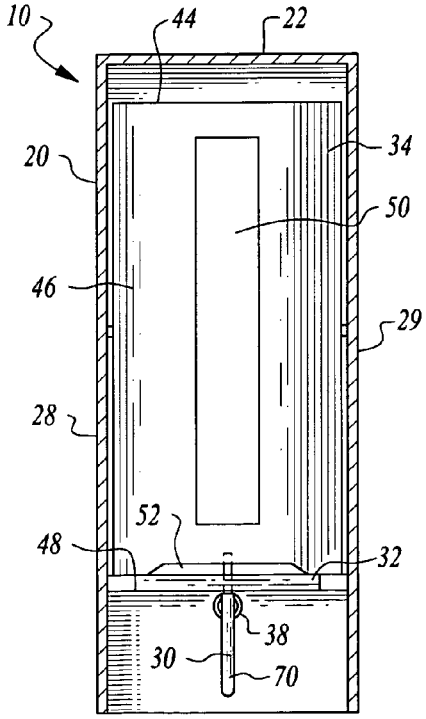
FIG. 3 is a front cross-sectional view along lines 3-3 of FIG. 1 of the lid separator and dispensing device according to a preferred embodiment of the present invention.
Figure 4:
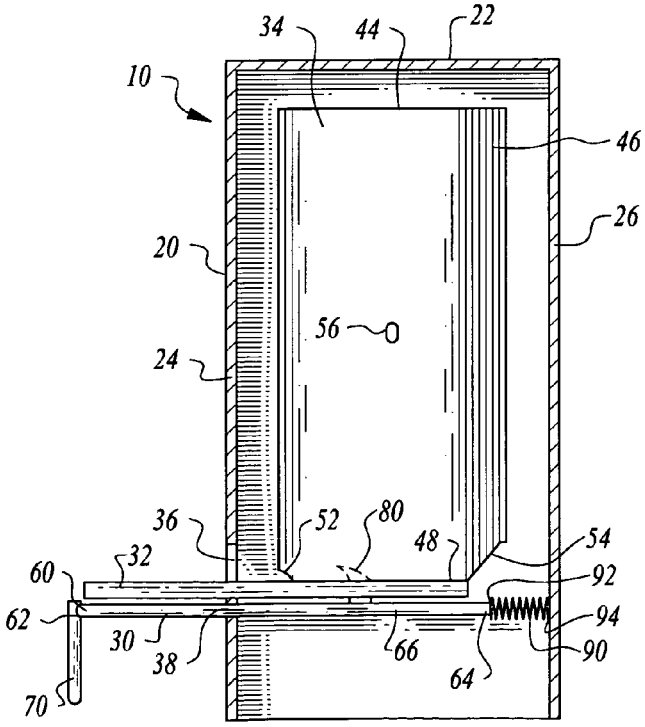
FIG. 4 is a right side cross-sectional view along lines 4-4 of FIG. 1 of the lid separator and dispensing device according to a preferred embodiment of the present invention.
Figure 5:
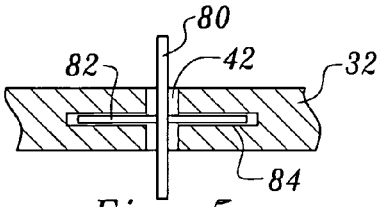
FIG. 5 is a partial front cross-sectional front view of a channel and hook of the lid separator and dispensing device according to a preferred embodiment of the present invention.
Figure 6:
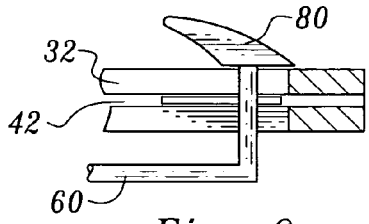
FIG. 6 is a partial cross-sectional side view of the channel and hook of the lid separator and dispensing device according to a preferred embodiment of the present invention.
Figure 7:
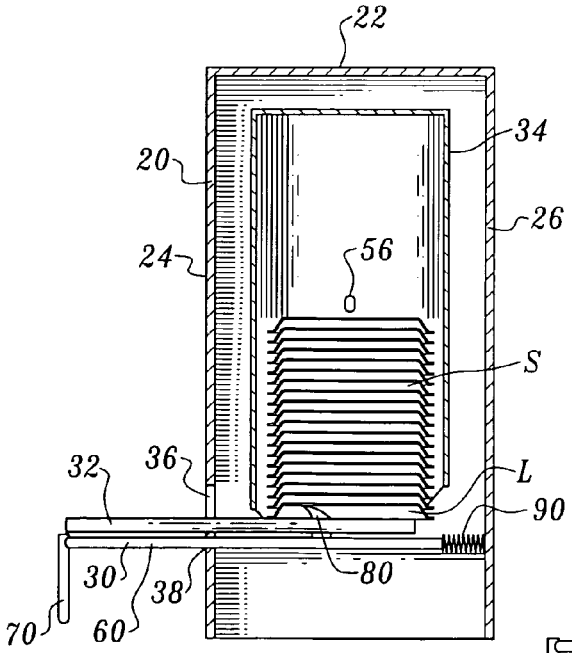
FIG. 7 is a right side cross-sectional view of the lid separator and dispensing device according to a preferred embodiment of the present invention, showing a pull assembly and vessel in a default position.
Figure 8:
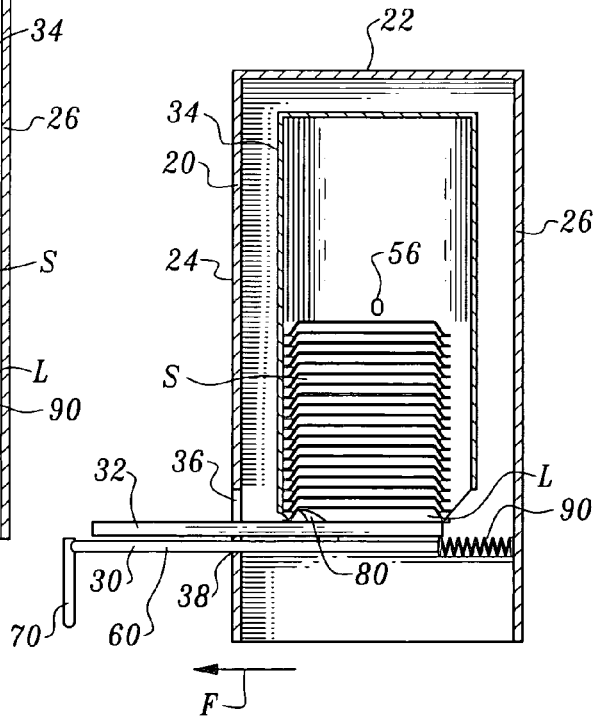
FIGS. 8-14 are right side cross-sectional views of the lid separator and dispensing device according to a preferred embodiment of the present invention, showing the pull assembly in sequential stages of operation.
Figure 9:
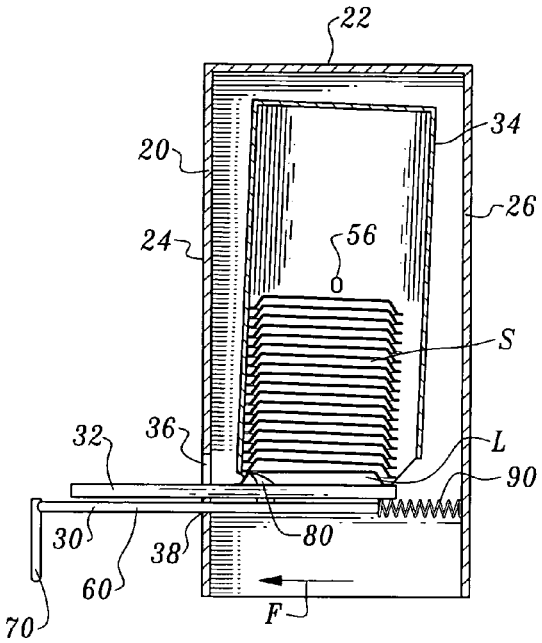
Figure 10:
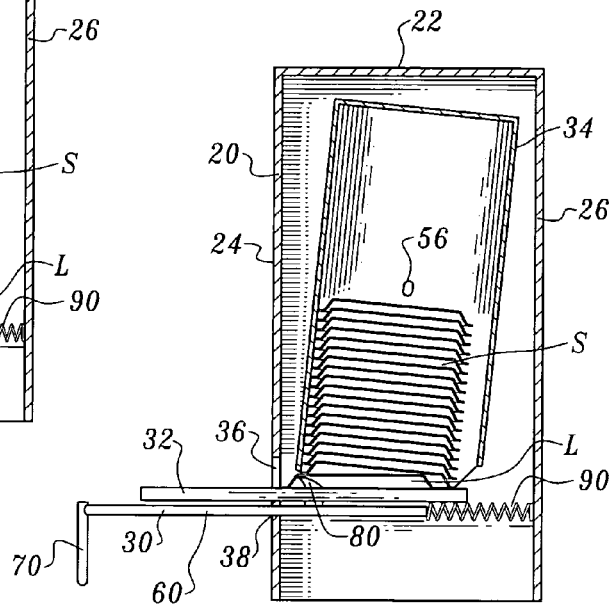
Figure 11:
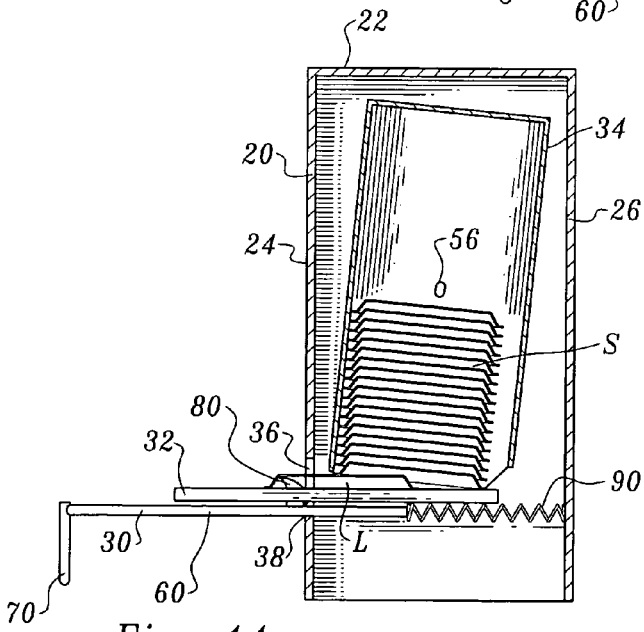
Figure 12:
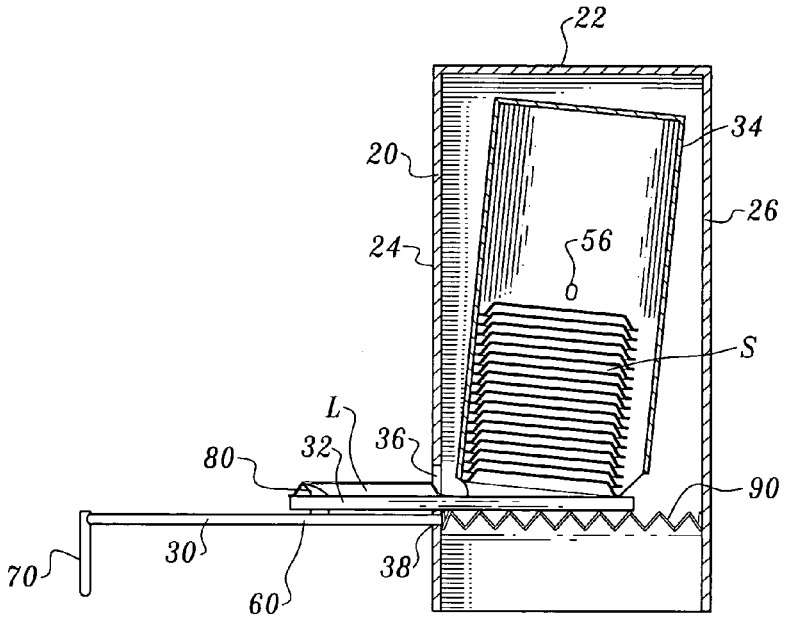
Figure 13:
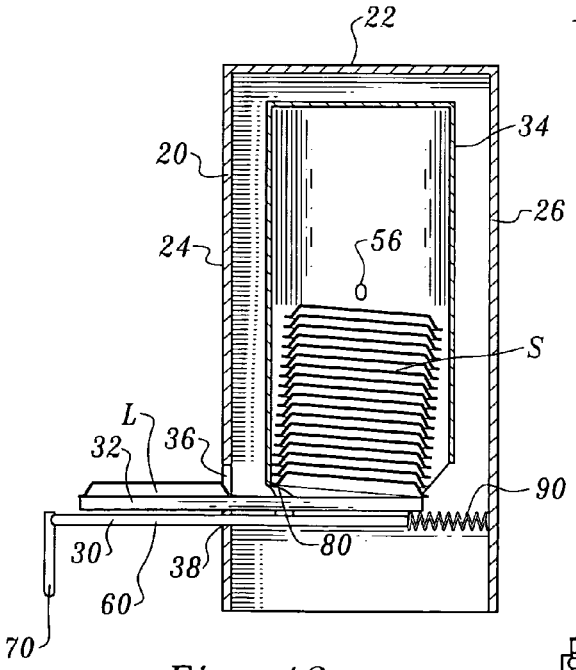
Figure 14:
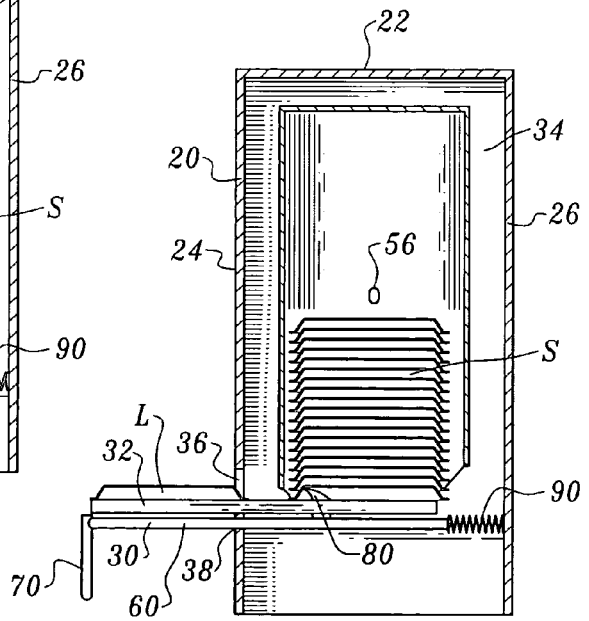
Figure 15:
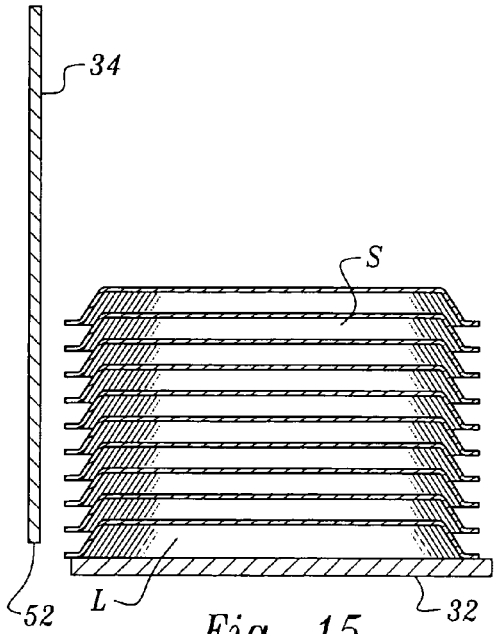
FIG. 15 is a right side cross-sectional view of the lid separator and dispensing device according to the preferred embodiment of the present invention, showing a stack of lids being held within a vessel and on top of a base, before use of the invention.
Figure 16:
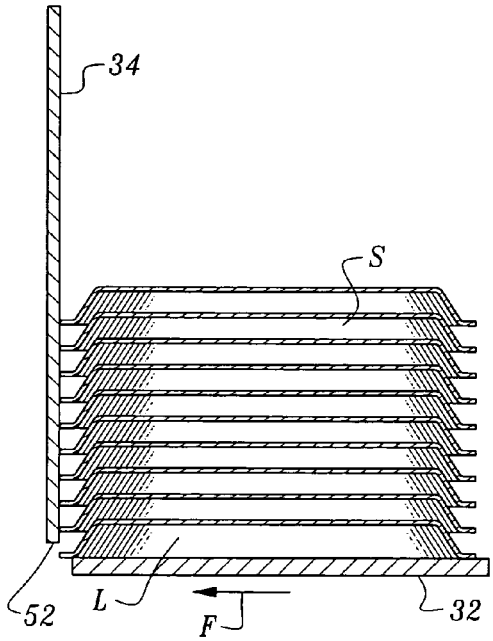
FIG. 16 is a right side cross-sectional view of the lid separator and dispensing device generally showing the operative features the present invention, showing the stack of lids being held adjacent an abutment and on top of a base, wherein the stack of lids are contacting the vessel in a first stage in the use of the invention.
Figure 17:
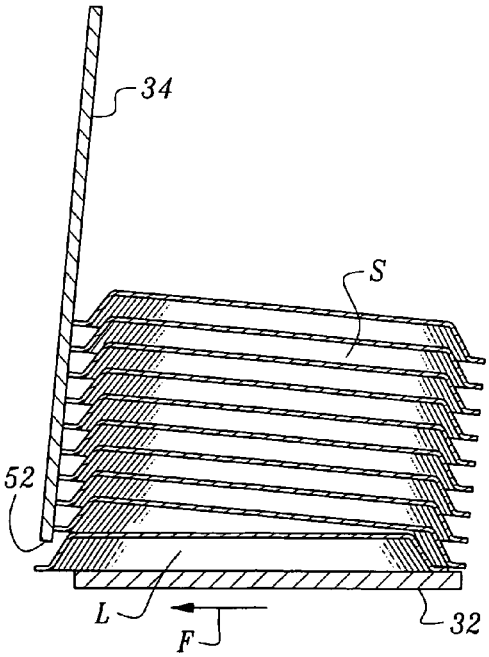
FIG. 17 is a right side cross-sectional view of the lid separator and dispensing device of FIG. 16, showing the stack of lids being held adjacent an abutment and on top of a base, wherein the vessel is being pivoted upwards in a second stage in the use of the invention.
Figure 18:
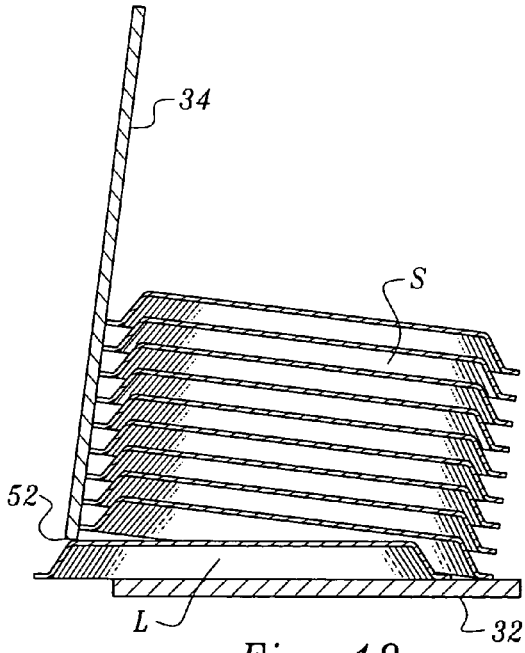
FIG. 18 is a right side cross-sectional view of the lid separator and dispensing device of FIG. 16, showing the stack of lids being held adjacent an abutment and on top of the base, wherein a bottom lid is being pulled out from under the stack in a third stage in the use of the invention.
Figure 19:
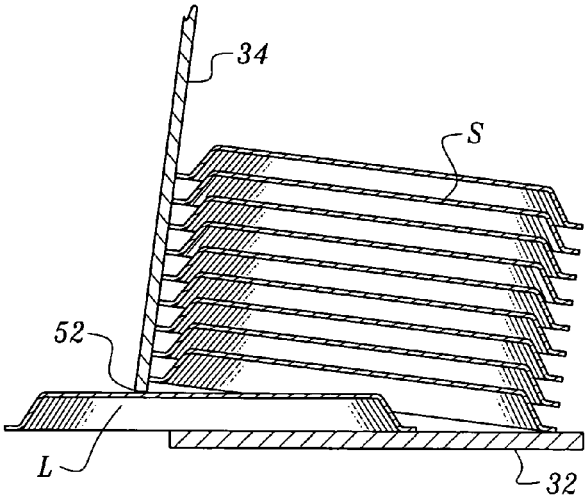
FIG. 19 is a right side cross-sectional view of the lid separator and dispensing device of FIG. 16, showing the stack of lids being held adjacent an abutment and on top of the base, wherein the bottom lid is being pulled out from under the stack in a fourth stage in the use of the invention.
Figure 20:
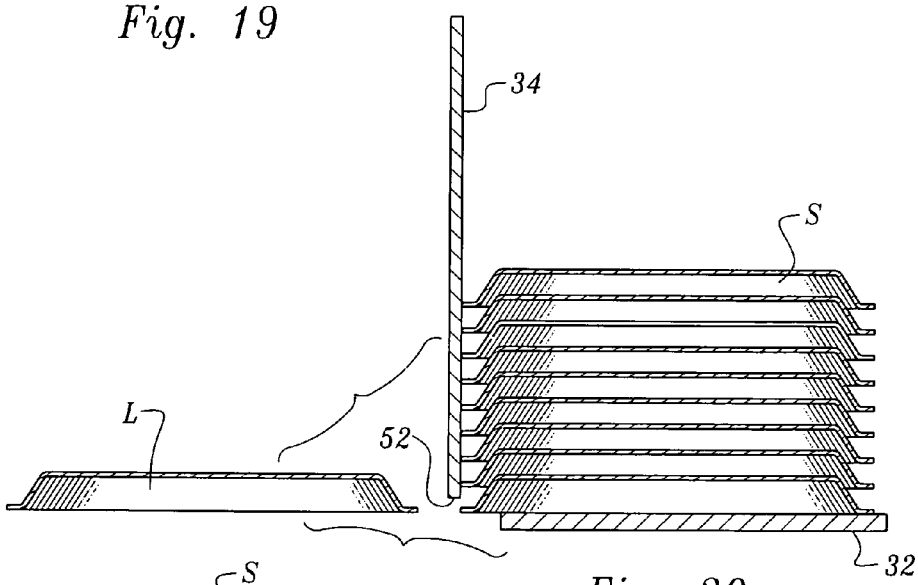
FIG. 20 is a right side cross-sectional view of the lid separator and dispensing device of FIG. 16, showing the stack of lids being held adjacent an abutment and on top of the base, wherein the previous bottom lid has been pulled out from under the stack in a fifth stage in the use of the invention.
Figure 21:
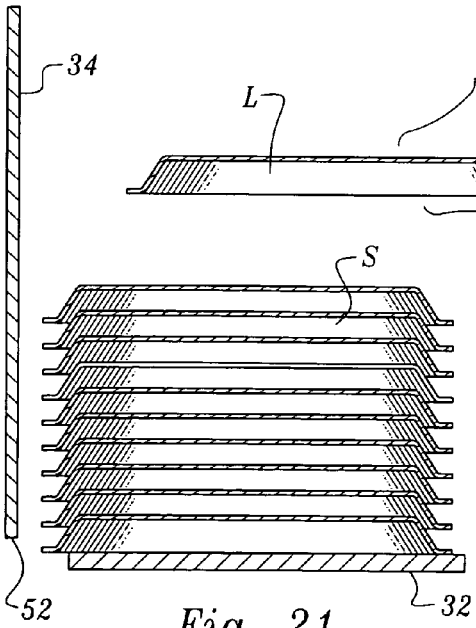
FIG. 21 is a right side cross-sectional view of the lid separator and dispensing device of FIG. 16, showing the stack of lids being held adjacent an abutment and on top of the base after completion of a full lid removal process of the invention, with the lid separator and dispensing device returned to the initial position of FIG. 15.

In describing the preferred embodiment of the present invention, as illustrated in FIGS. 1-21, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-14, the present invention in a preferred embodiment is dispenser 10, wherein dispenser 10 generally comprises housing 20 and pull assembly 30. Dispenser 10 is preferably utilized for storing and dispensing beverage container lids; however, it is contemplated that dispenser 10 could be utilized to store and dispense other articles, such as, for exemplary purposes only, disks, plates, bowls, saucers, caps, rings and other similarly shaped articles. Preferably, dispenser 10 and its unique configuration of components are adapted to receive, store and dispense beverage container lids of virtually all sizes, shapes and/or styles. Dispenser 10 is preferably formed from plastic, although it is recognized that other alternatively suitable materials could be utilized to form dispenser 10, such as, for exemplary purposes only, cardboard, glass, metal, metal alloys, composites, or any other synthetic materials.

Preferably, housing 20 is of an orthorhombic shape, wherein housing 20 generally comprises top surface 22, front surface 24, back surface 26, first side surface 28, second side surface 29, base 32 and impediment 34, wherein top surface 22, front surface 24, back surface 26, first side surface 28, second side surface 29 are preferably formed to create a casing for storing beverage container lids therewithin. The top surface 22 is preferably either removable or otherwise includes a door to allow lids to be loaded into the housing 20.

Preferably, front surface 24 comprises apertures 36 and 38, wherein an optional door 40 and base 32 are situated within aperture 36. Preferably, aperture 36, door 40 and base 32 are rectangular-shaped, wherein door 40 is situated within an upper portion of aperture 36, and wherein base 32 is perpendicularly disposed within a lower portion of aperture 36. Door 40 is preferably hingedly connected to front surface 24 to permit access to the interior of housing 20. Base 32 is preferably secured within aperture 36 via adhesives, although it is contemplated in alternative embodiments that other suitable fasteners may be utilized, such as, for exemplary purposes only, bolts, screws, pins, pegs, clamps, clasps, clips, a tab and slot system, frictional fit, or alternatively base 32 could be integrally formed to housing 20.

Preferably, base 32 comprises channel 42, wherein channel 42 is an elongated slit that is centrally disposed within base 32. Best seen with reference to FIG. 5, channel 42 preferably possesses a cross-shaped cross-section. Base 32 preferably functions to retain beverage container lids thereon, as more fully described below.

Preferably, aperture 38 is centrally disposed below aperture 36, wherein aperture 38 is preferably circular-shaped. Aperture 38 functions to receive and retain pull assembly 30 therewithin, as more fully described below.

Vessel 34 is preferably a cylindrical vessel for holding the stack of beverage cup lids dispensed when dispenser 10 is in use, as more fully described below, wherein vessel 34 preferably comprises top edge 44, peripheral wall 46, rim 48, aperture 50, front notch 52 and rear notch 54. Aperture 50 preferably assists the insertion of beverage cup lids within vessel 34, which are loaded from above through the door in the top surface 22, and allows the number of lids in the vessel 34 to be viewed. Front notch 52 provides a preferred form of gap or aperture which facilitates the dispensing of beverage cup lids therethrough, and rear notch 54 permits the tilting of vessel 34 within housing 20.

Preferably, peripheral wall 46 of vessel 34 is pivotally attached to first side surface 28 and second side surface 29 of housing 20. Vessel 34 is preferably attached to housing 20 via pivot 56, wherein pivot 56 is preferably a conventional peg and slot system. It is recognized in an alternative embodiment, however, that pivot 56 could embody other suitable attachment means, such as, for exemplary purposes only, bearings, pins, bolts, dowels, swing cords, etc. or the vessel 34 could be non-pivoting, and rather remain stationary or experience only vertically sliding, a rotating motion or distortion/bending if the vessel 34 is formed of flexible material.

The vessel 34 could itself be omitted, or modified, provided that some form of abutment is provided against which at least some of the lids or similar items in the stack can touch, to keep these lids or similar items other than the bottom lid from sliding off of the bottom of the stack. For instance, the abutment could be a flat fixed wall with a gap at a bottom thereof only large enough to allow the bottom lid to slide past. The gap could be bordered on the abutment with a tooth or other divider extending away from the abutment and toward the stack which would slide between the bottom lid and other lids/items in the stack to separate the bottom lid/item from the stack. This abutment could be a surface of the housing itself. By pivoting of the abutment in the form of the vessel 34, separation of the bottom lid/item from the stack and holding the stacks is particularly facilitated.

Preferably, pull assembly 30 facilitates the dispensing of beverage container lids from dispenser 10, as more fully described below, wherein pull assembly 30 generally comprises rod 60, handle 70 and hook 80. Preferably, rod 60 is cylindrical-shaped, wherein rod 60 is disposed within aperture 38 of housing 20, and wherein rod 60 preferably comprises first end 62, second end 64 and upper rear portion 66. Preferably, handle 70 is cylindrical-shaped, wherein handle 70 is integrally formed to first end 62 of rod 60. Preferably, hook 80 is substantially fin-shaped, wherein hook 80 is integrally formed to upper rear portion 66 of rod 60, and wherein hook 80 is situated within channel 42 of base 32 of housing 20. As best shown with reference to FIG. 5, hook 80 comprises flanges 82 and 84, wherein flanges 82 and 84 function to restrict the movement of hook 80 within channel 42 of base 32, as more fully described below.

Preferably, pull assembly 30 is attached to back surface 26 of housing 20 via spring 90, wherein spring 90 is a conventional metal coil that functions to return pull assembly 30 to its default position, as more fully described below. Preferably, spring 90 comprises first end 92 and second end 94, wherein first end 92 of spring 90 is affixed to second end 64 of rod 60, and wherein second end 94 of spring 90 is affixed to back surface 26 of housing 20.

While this particularly described pull assembly 30 provides one form of actuator for the separator and dispenser 10 of this invention, other actuators could be used to provide the general function of engaging the bottom lid/item in the stack and exerting a force sliding the bottom lid/item laterally away from other lids/items remaining in the stack. Any means to engage and slide the bottom lid/item of the stack could similarly be used.

To operate dispenser 10, beverage container lids are loaded into housing 20, wherein the door in the top 22 of housing 20 is preferably opened, and beverage container lids are inserted into the vessel 34. As best shown with reference to FIGS. 7, 15 and 21, stack S is formed within vessel 34, wherein stack S preferably rests on base 32 of housing 20, and wherein bottom lid L of stack S rests underneath hook 80 of pull assembly 30. To dispense a beverage container lid with this embodiment of the invention, handle 70 of pull assembly 30 is grasped by a user's hand, wherein the user pulls pull assembly 30 to create force F, and wherein force F preferably draws hook 80 of pull assembly 30 through channel 42 of base 32. Preferably, hook 80 grasps bottom lid L of stack S, wherein force F pulls stack S toward front surface 24 of housing 20 until stack S comes into contact with a front wall of the vessel 34. Best shown with reference to FIGS. 8-9 and 16-17, as force F moves stack S into a position where it meets the resisting force of the vessel 34 wall, vessel 34 is preferably tilted, wherein top wall 44 of vessel 34 is preferably pivoted toward back surface 26 of housing 20, and wherein rim 48 of vessel 34 is preferably pivoted toward front surface 24 of housing 20. Consequently, front notch 52 of vessel 34 is preferably pivoted away from base 32, and rear notch 54 is preferably pivoted toward base 32.

Best shown with reference to FIGS. 10-11 and 18-19, as force F acts on the bottom lid L and causes the stack S and vessel 34 to pivot/lift, and preferably lifts front notch 52 of vessel 34 away from base 32, force F preferably pulls bottom lid L away from stack S, wherein vessel 34 preferably catches stack S and lifts stack S slightly, thereby removing stack S from force F, maintaining stack S within housing 20. Bottom lid L is preferably pulled between front notch 52 and base 32, and through aperture 36 of housing 20. As best shown with reference to FIGS. 12-14 and 20-21, the user preferably ceases pulling on handle 70 of pull assembly 30 when bottom lid L is completely removed from vessel 34, wherein gravity preferably pivots vessel 34 to its default position on base 32, and wherein spring 90 preferably returns pull assembly 30 to its default position within housing 20. The fin-like shape of hook 80 preferably pushes stack S upwards to allow hook 80 to move underneath stack S, wherein dispenser 10 is reset to dispense another beverage container lid to a subsequent user.

FIGS. 15-21 more generally show an abutment that could optionally be a portion of the vessel 34, to illustrate the most basic separation function of this invention. A support surface below the stacks could optionally be the base 32. This support surface abuts the end lid L in the stack S. Some form of actuator, such as the pull assembly 30 with hook 80 passes through the support surface and engages the end lid L. This actuator could optionally be positioned more entirely above the base 32 or other support surface. In FIGS. 15-21 no specific actuator is shown.

It is recognized in an alternative embodiment that vessel 34 could remain tilted after bottom lid L is dispensed from housing 20, wherein upon returning to its default position within housing 20, hook 80 of pull assembly 30 pushes stack S, and consequently vessel 34, to its default position within housing 20. Such an arrangement beneficially also can utilize the hook 80 to push the remaining lids L in the stack S away from the vessel 34 wall or other abutment, should the lids become lodged against the vessel 34 wall.

In another alternative embodiment, top wall 44 of vessel 34 and top surface 22 of housing 20 could be removable to facilitate refilling of beverage container lids therethrough.

In yet another alternative embodiment, pull assembly 30 could embody a lever, wherein hook 80 is drawn through an arcuate shaped channel 42 in base 32 of housing 20. It is further recognized in such an embodiment that spring 90 could be replaced by a weighted counterbalance to return pull assembly to its default position.

In a further alternate embodiment, spring 90 could embody any type of elastic retention member.

In still a further alternate embodiment, housing 20 could embody a base member with brackets, wherein vessel 34 is pivotally mounted to the brackets.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. For instance, while some references have been made to vertical and horizontal, with appropriate accommodation, such as a spring pressing down on the stack of lids/items, the parts of the separator/dispenser 10 could be reoriented to any desired orientation, such as with the stack extending diagonally, horizontally or upside down. Also, the actuator could be semi or fully automatic and actuated by pushing a button, etc. with all function controlled by servo-motors or other automatic force applying elements. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A dispenser for dispensing stacked items, said dispenser comprising:

at least one vessel adapted to store a plurality of the items, said vessel including an abutment adjacent an aperture;

at least one actuator carried proximal to said at least one vessel, said actuator adapted to move one item in the stack of items through said aperture while at least one adjacent item contacts said abutment;

wherein said at least one vessel has an upper portion and a lower portion, and wherein said at least one vessel has said aperture formed proximal to said lower portion in the form of an open lower end of said at least one vessel with said abutment adjacent and above said aperture;

wherein said at least one actuator is adapted to underlie said open lower end and slide relative to said vessel; and wherein said at least one vessel is pivotally carried relative to said actuator; and wherein said at least one actuator is adapted to cause said at least one vessel to pivot, at least indirectly, to facilitate one of the plurality of items being removed from said at least one vessel via said aperture, when said actuator is pulled.

2. The dispenser of claim 1 wherein said at least one actuator comprises a pull assembly including a hook adapted to engage one of the plurality of items stored within said at least one vessel adjacent said aperture to remove one of the plurality of items from said at least one vessel via said aperture when said pull assembly is pulled.

3. The dispenser of claim 2 further including a spring in mechanical communication with said pull assembly, said spring adapted to urge said hook of said pull assembly to an original position beneath said vessel.

4. The dispenser of claim 1 wherein said at least one vessel is generally cylindrical in form and oriented substantially vertically within a housing, with said vessel pivotably attached by a substantially horizontal axle to said housing.

5. A separator for separating a lid from a stack of lids, comprising in combination:

at least one support surface adapted to hold at least one stack of lids adjacent thereto;

at least one abutment surface non-parallel with said support surface;

said abutment spaced from said support surface by a gap;

at least one actuator adapted to move relative to said support surface and extend past said support surface to engage a lowermost lid within the stack of lids, said actuator adapted to move a lid at an end of the stack adjacent the support surface through said gap when said actuator moves;

wherein said at least one actuator is adapted to cause said at least one stack of lids to move, at least indirectly, when said actuator is moved;

wherein the abutment is adapted to move away from said support surface to enlarge said gap to a size at least as large as the lid to be separated from the stack; and wherein said abutment is provided at a lower end of a vessel, said vessel adapted to contain the stack of lids, said vessel adapted to move relative to said support surface with said abutment moving along with said vessel.

6. The separator of claim 5 wherein said vessel is cylindrical in form with an open lower end and a open upper end, said upper end adapted to receive the stack of lids therein, said gap located adjacent said lower end of said vessel.

7. The separator of claim 6 wherein said vessel is pivotably attached to a housing surrounding said vessel, said vessel pivotably attached to said housing on a portion of said vessel closer to said upper end than to said lower end.

* * * * *